US005136956A

United States Patent [19]

Kitamura

[11] Patent Number: 5,136,956

[45] Date of Patent: Aug. 11, 1992

[54] SEAM FORMING DEVICE OF BLINDSTITCHING MACHINE FOR FABRIC END AT SEWING START

[75] Inventor: Hideo Kitamura, Toyonaka, Japan

[73] Assignee: Yamato Mishin Seizo Kabushiki Kaisha, Osaka, Japan

[21] Appl. No.: 675,974

[22] Filed: Mar. 28, 1991

[30] Foreign Application Priority Data

Apr. 6, 1990 [JP] Japan ..... 2-37494[U]

[51] Int. Cl.[5] ..... D05B 1/24; D05B 27/00

[52] U.S. Cl. ..... 112/178; 112/304

[58] Field of Search ..... 112/176, 304, 318, 177, 112/178, 267.1, 322, 303, 320, 268.1

[56] References Cited

U.S. PATENT DOCUMENTS 4,311,106 1/1982 Hanneman ..... 112/304 X 4,594,955 6/1986 Lichtenberg ..... 112/304 X

FOREIGN PATENT DOCUMENTS 4522699 11/1967 Japan ..... 112/304

761633 9/1980 U.S.S.R. ..... 112/304

765428 9/1980 U.S.S.R. ..... 112/304

*Primary Examiner*—Werner H. Schroeder

*Assistant Examiner*—Paul C. Lewis

*Attorney, Agent, or Firm*—Wenderoth, Lind & Ponack

[57] ABSTRACT

A seam forming device is provided for a blindstitching machine for starting a seam at the fabric end. This device has a fabric feeding apparatus positioned direct in front of a feed dog, so as to enable it to form seams which begin at the fabric end at which sewing is initiated. This eliminates the unseamed portion at the fabric end at which sewing is initiated, which has previously been inevitable when sewing with a conventional blindstitching machine. Thus, with the present invention, it is no longer necessary to manually finish the seam after blindstitching.

19 Claims, 7 Drawing Sheets

FIG. 1
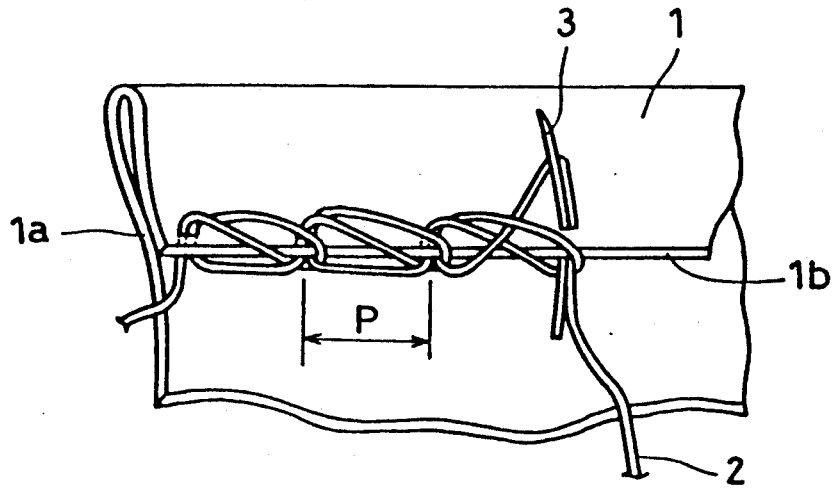
FIG. 2 - PRIOR ART
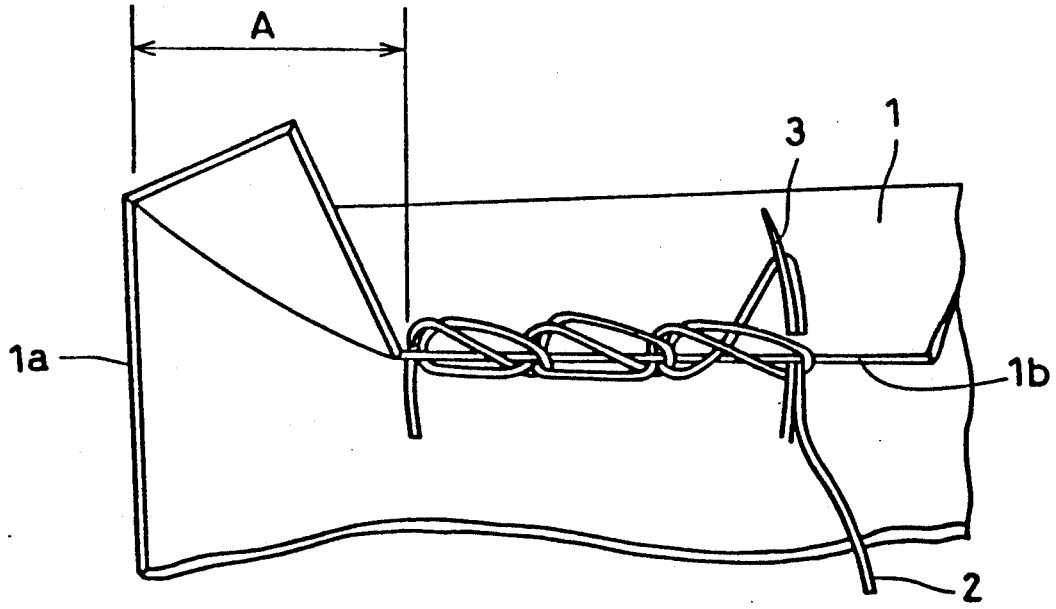

FIG.11 - PRIOR ART
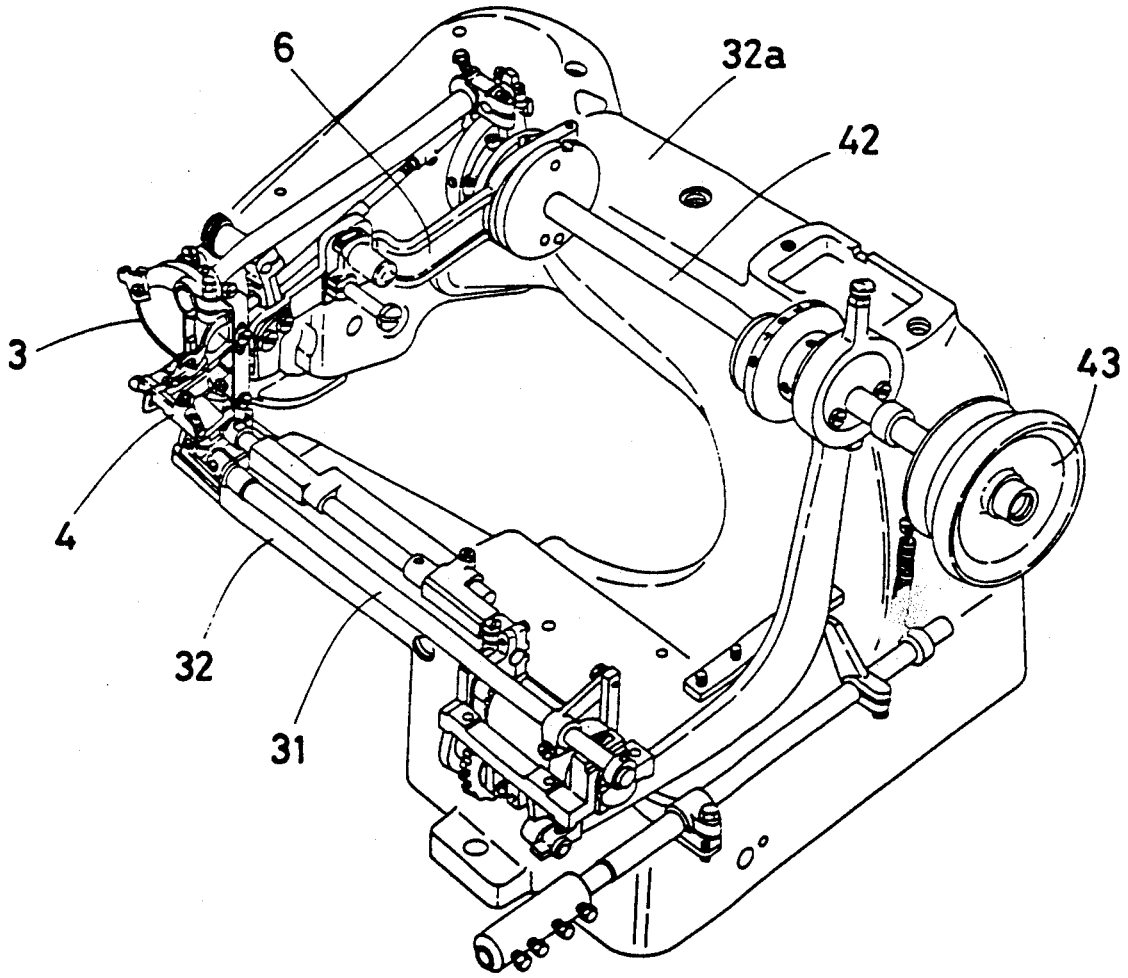

SEAM FORMING DEVICE OF BLINDSTITCHING MACHINE FOR FABRIC END AT SEWING START

BACKGROUND OF THE INVENTION

1. Field of the Invention

This invention relates to a seam forming device for a blindstitching machine for providing a seam at a fabric end at which sewing is initiated. This device is provided with a fabric feeder immediately in front of a feed dog to enable it to form seams beginning at the fabric end at which sewing is initiated.

2. Description of the Prior Art

In a conventional blindstitching machine, a feed dog for feeding fabric is provided at the rear of a felling portion. During blindstitching of a workpiece (fabric), sewing must be initiated by placing the workpiece (fabric) under the feed dog which is located at the back of the felling portion (seam forming portion). Therefore, it is inevitable that an unseamed portion A (a specified length of the fabric near the end thereof from which sewing was initiated at which no seam has been formed) will result, which unseamed portion A must be sewn manually after the mechanical blindstitching has been completed. Thus, to form a suitable seam using a conventional blindstitching machine, both mechanical operations and manual operations are required. This not only requires a significant amount of labor, but can also result in unevenly finished workpieces.

Although it has been known to provide fabric feeding devices at the front of and at the rear of a seam forming portion, such as a felling portion, for lockstitch machines, overlock machines, and the like, and various types of these devices have been put to practical use, such devices are not applicable to blindstitching because of a peculiar mechanism of the blindstitching machine.

SUMMARY OF THE INVENTION

An object of the present invention is to provide a seam forming device for a blindstitching machine for providing a seam at a fabric end at which sewing is initiated, which is suitable for use with the peculiar mechanism of a blindstitching machine, and which can form seams beginning at the fabric end at which sewing is initiated.

In order to attain the above object, the device of the present invention has the following structure.

Belt pulleys are rotatably mounted by axles to the sides of two-split fabric pressers which are positioned at the rear of a felling portion immediately forward of and below a feed dog, and another belt pulleys is rotatably mounted by an axle to a lever which is rotatably mounted to the front of said fabric pressers. Belts are trained about the belt pulleys at the sides of the fabric pressers and at the lever. The belt pulley which is mounted by an axle to the lever is caused to rise and fall with the lever and with the fabric pressers. By rotating the axle of the belt pulley at the lever by way of a flexible rotation transmission means, the belts are rotated along the undersurface of the fabric pressers to move the fabric edge from the front of the fabric pressers toward a position immediately forward of the feed dog.

BRIEF DESCRIPTION OF THE DRAWINGS

The nature and advantage of the present invention will be understood more clearly from the following description made with reference to the accompanying drawings, in which:

FIG. 1 is a perspective view of a main part of a fabric end at the beginning of a sewing operation performed by a device according to the present invention;

FIG. 2 is a perspective view of a main part of a fabric end at the beginning of a sewing operation performed by a conventional device;

FIG. 11 is a schematic illustration of a feeding mechanism of the conventional blindstitching machine.

DETAILED DESCRIPTION OF THE INVENTION

A description is made below of a seam forming device for a blindstitching machine for providing a seam at a fabric end at which sewing is initiated, with reference to the accompanying drawings showing embodiments of the present invention.

Figure 3:
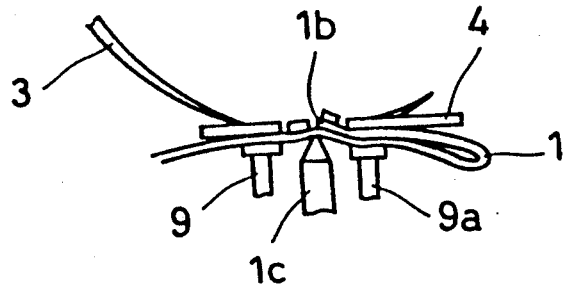
FIG. 3 is a front view of a main part of a seam forming portion of the device according to the present invention.

Reference numeral 1 designates a fabric to be blindstitched. FIG. 3 shows a fabric edge 1*b* turned up and inwardly to form a double layer at the right side of the figure, and a single layer of the fabric 1 at the left side of the figure. The single and double layer parts of the fabric 1 are pressed against the undersurface of a presser foot plate 4 by a conventional fabric presser 9 (to be described later) and by another conventional fabric presser 9*a* (to be described later), respectively. A portion of the fabric 1 at which the fabric edge 1*b* is positioned in FIG. 3 is contacted by a ridge forming plate 1*c* so as to lift the contact part (the part of the fabric 1 where the fabric edge 1*b* contacts the rest of the fabric 1) to a level at which a curved needle 3 can pass through the contact part to blindstitch with a sewing thread 2.

Figure 4:
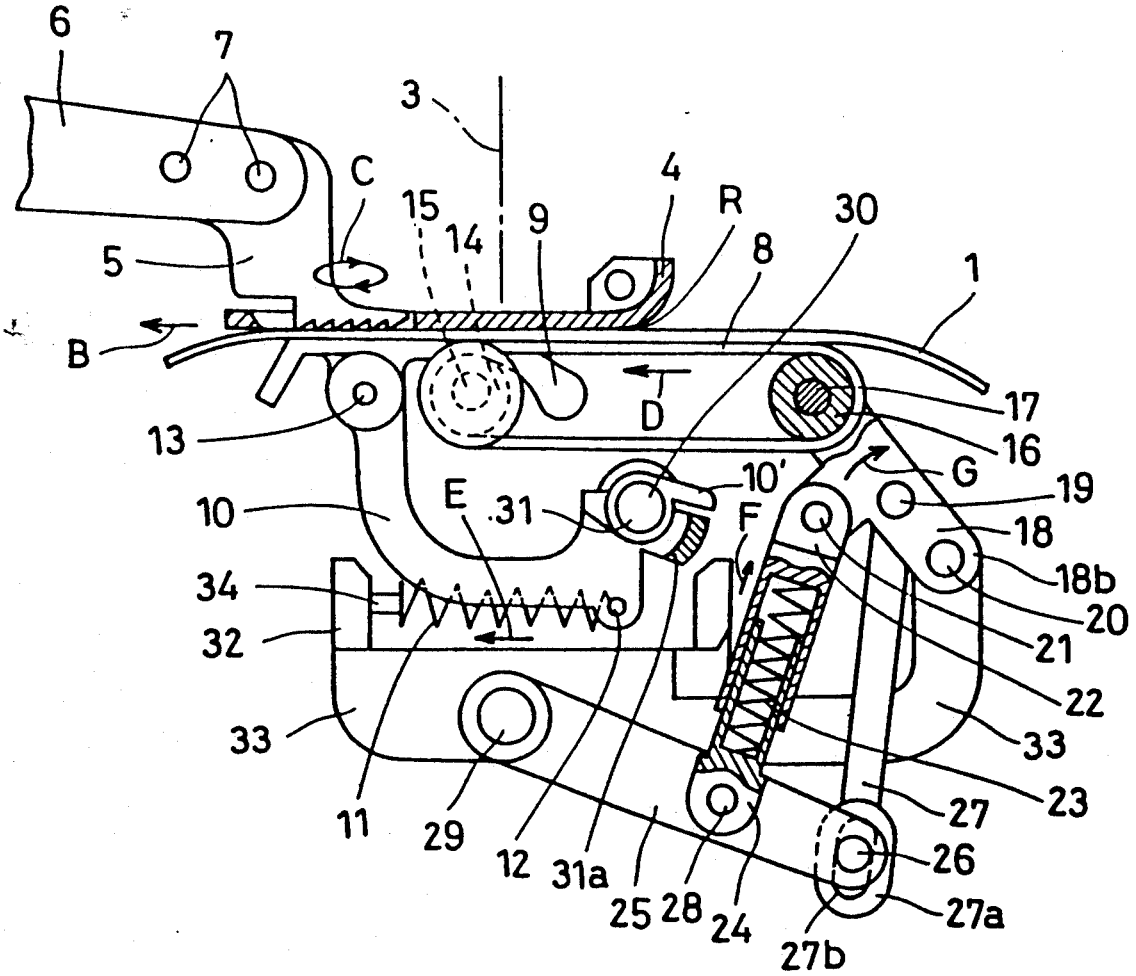
FIG. 4 is a partially sectional left side view of a portion of a blindstitching machine provided with a device according to the present invention.

Reference numeral 5 designates a conventional feed dog which is fixed to a feed lever 6 by set screws 7 and is adapted to be moved along an elliptical path represented by arrow C along with the presser foot plate 4. This feed dog 5 rakes in the fabric end 1*a* as the fabric 1 is being fed by a timing belt 8 (8*a*) as the sewing operation begins and conveys the fabric 1 in the direction of the arrow B in FIG. 4, namely, from the front toward the rear. The fabric presser 9 (9*a*) is swingably mounted at a rear lower part thereof to an end of a presser foot lever 10 (10*a*) by a fulcrum shaft 13 (13*a*). The other end of the presser foot lever 10 (10*a*) is swingably mounted to a forward end of a presser foot depressing shaft 31 by a fulcrum shaft 30. A tension spring 11 is interposed between a screw 12 (12*a*) mounted to a lower end of the lever 10 (10*a*) and a screw 34 mounted to a top end 32 projecting from a blindstitching machine main body (illustrated at 32*a* in FIG. 11 as part of the conventional blindstitching machine). The biasing force of the tension spring 11 acting in the direction of the arrow E forces the presser foot lever 10 (10*a*) to rotate clockwise (in FIG. 4), such that the presser foot lever 10 (10*a*) presses, via the fabric presser 9 (9*a*), the fabric 1 against the presser foot plate 4 at a required moderate pressure.

Figure 5:
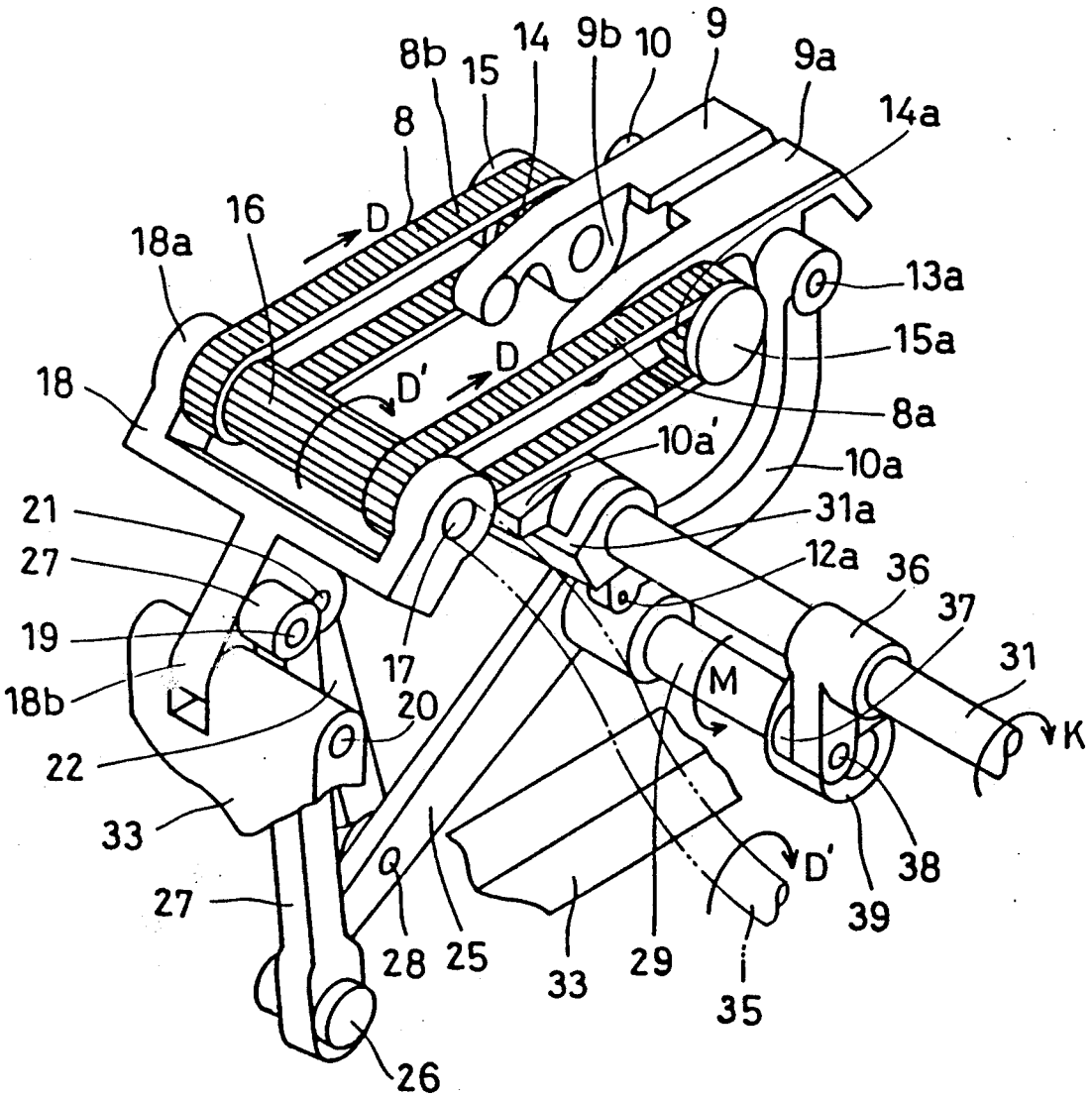
FIG. 5 is a perspective view as seen from the right side of the device according to the present invention.
Figure 6:
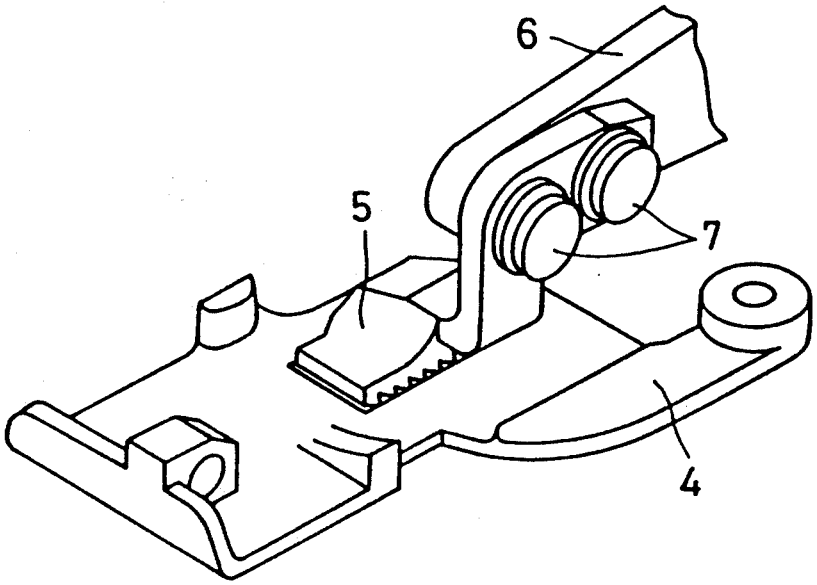
FIG. 6 is a perspective view of portions of a presser foot plate and a feed dog as seen from the right side of the device according to the present invention.
Figure 8:
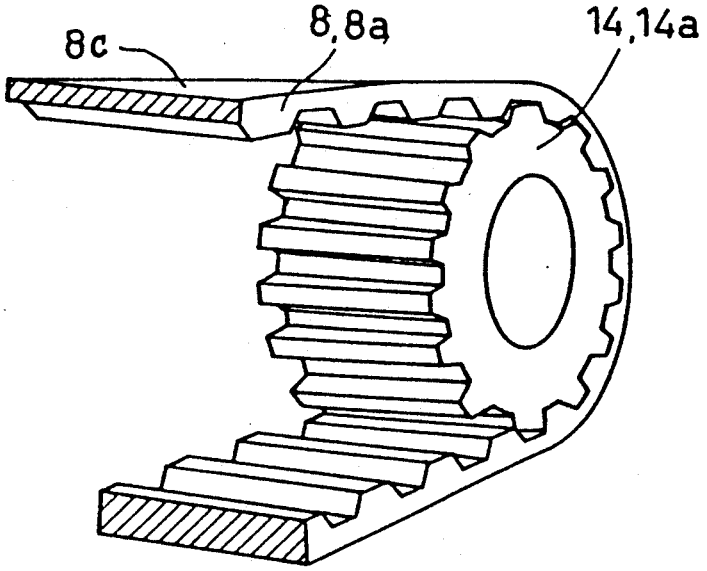
FIG. 8 is an enlarged perspective view of a timing belt and a timing belt pulley.

The timing belt 8 (8*a*) has either a rugged surface 8*b* (FIG. 5) or a flat surface 8*c* (FIG. 8), depending upon the kind of fabric to be sewn. The timing belt 8 (8*a*) is trained about a timing belt pulley 14 (14*a*) which is rotatably mounted by an axle 15 (15*a*) to a bearing 9*b*, and another timing belt pulley 16 (the same as the timing belt pulley 14 (14*a*) in width and diameter) which is fixed to a shaft 17 mounted rotatably in a yoke-shaped bearing (or yoke) 18*a*. The yoke 18*a* is formed at a top part of a lever 18 which is rotatably mounted at its base end 18*b* to a top end part of a bracket 33 (to be described later) by a pin 20. The upper surface of the timing belt 8 (8*a*) is disposed at the same level as the upper surface of the fabric presser 9 (9*a*).

The presser foot depressing shaft 31 is adapted to be rotated clockwise (in the direction of the arrow K in FIG. 5) by a knee or foot when the fabric 1 is to be mounted on or removed from the machine at the beginning or completion of sewing. When the presser foot depressing shaft 31 is rotated, a cloth retainer 31*a* fixed to the presser foot depressing shaft 31 lifts a cloth retainer 10' (10*a*') of the presser foot lever 10 (10*a*) such that it rotates clockwise in the direction of arrow K in FIG. 5 (counterclockwise in the direction of K' in FIG. 7) and swings the presser foot lever 10 (10*a*) against the bias of the tension spring 11, such that the fabric presser 9 (9*a*) is lowered in the direction of the arrow L in FIG. 7. The above-mentioned mechanism is conventional.

The bracket 33 (which defines part of the frame) includes a middle part fixed to the top end 32 and a base end part having its upper surface fixed to the top end 32. A forward end portion of the bracket 33 is curved upwardly and rotatably supports the base end 18*b* of the lever 18. A shaft 29 is rotatably mounted to a base end portion of the bracket 33. A base end of a lever 25 is fixed to one end of the shaft 29 and a top end of the lever 25 is supported rotatably and slidably by a pin 26 and by a slot 27*b* formed at a widened end 27*a* of a connecting rod 27. The other end of the connecting rod 27 is rotatably mounted to the lever 18 at a center part of its base end portion 18*b* by a pin 19. A compressible spring 23 is interposed between spring holders 22, 24 beneath the center part of the lever 18. One end of the spring holder 22 is rotatably mounted to the lever 18 by a pin 21, and one end of the other spring holder 24 is rotatably mounted to the middle part of the lever 25 by a pin 28. Due to the expansion force of the compressible spring 23, spring holders 22, 24 are forced apart in the direction of the arrow F (in FIG. 4) and accordingly bias the lever 18 to rotate clockwise (in the direction of the arrow G in FIG. 4) with the pin 20 as a fulcrum.

Reference numeral 35 designates a rotation transmission means, such as a flexible pipe, a spring or the like. This rotation transmission means 35 transmits rotation, for example, by connecting one end thereof to a main shaft 42 of the main body 32*a* of the blindstitching machine by utilizing a conventional mechanism or by outputting a signal from the main shaft 42 and a pulley 43 to a stepping motor (not shown in the drawing) by means of an electrical device or the like. The other end of the rotation transmission means 35 is connected to one end of the axis 17 which is fixed for rotation with the timing belt 16. Rotation (in the direction of the arrow D') of the rotation transmission means 35 causes the belt 8 (8*a*) to rotate in the direction of the arrow D via the timing belt pulleys 14, (14*a*), 16, whereby the fabric 1 is carried from the front of the presser foot plate 4 toward the feed dog 5 along the presser foot plate 4. The rotary motion of the rotation transmission means 35 in the direction of the arrow D' is normally an intermittent movement carried out only when the needle 3 is pulled out of the fabric 1, but there are situations in which continuous rotation is carried out. The amount of fabric 1 that is fed by the rotary motion can be adjusted according to the coarseness of the seam, in a manner similar to the feed dog 5. Generally, one pitch (P in FIG. 1) of a seam is fed during one revolution of the pulley 43.

Reference numeral 36 designates a lever fixed to the presser foot depressing shaft 31. Reference numeral 39 designates a lever fixed to one end of the shaft 29 which is rotatably mounted to the base end portion of the bracket 33. A connecting rod 37 is rotatably mounted between the free ends of the levers 36, 39 by a pin 38. Elements 36, 37, 38 and 39 are referred to collectively as a connecting means.

Figure 7:
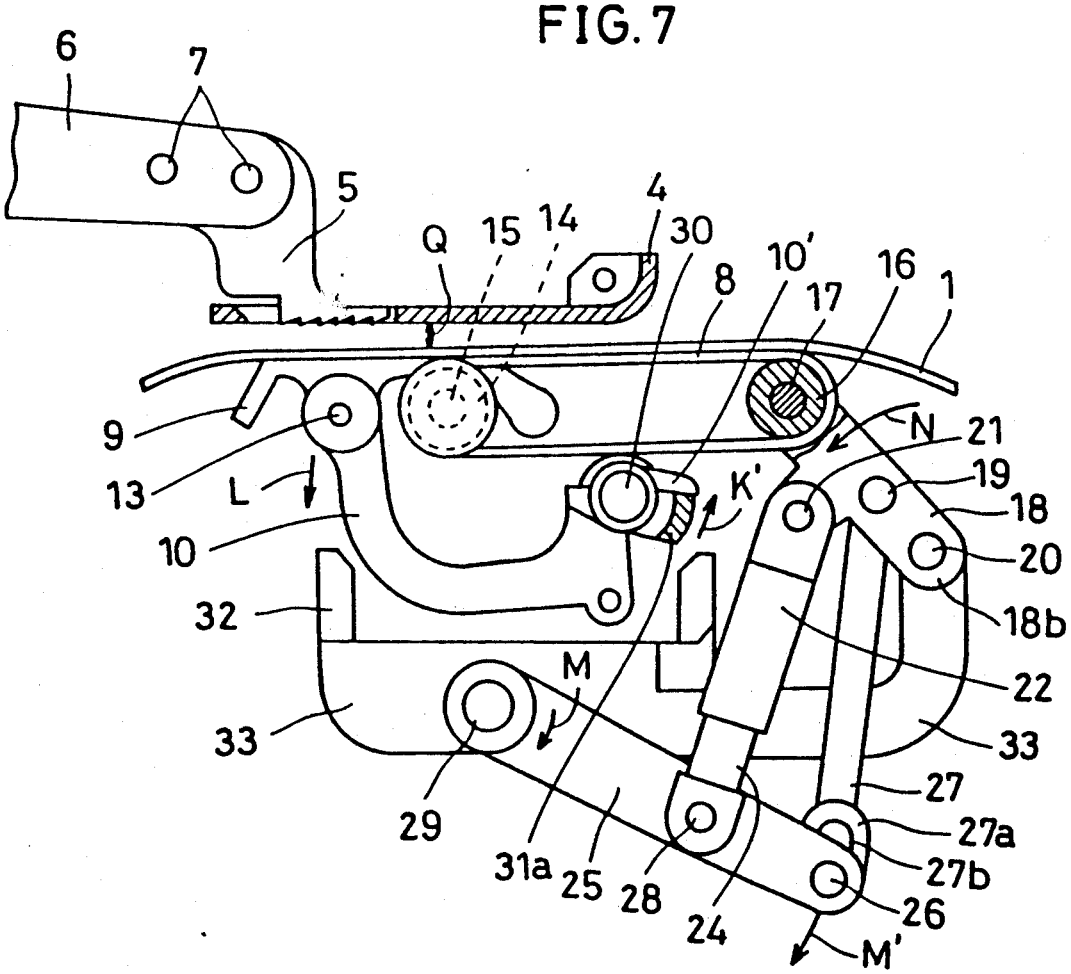
FIG. 7 is a partially sectional left side view of a portion of a blindstitching machine provided with the device according to the present invention, as the fabric is let in and let out.

In operation, when the presser foot depressing shaft 31 is rotated (in the direction of the arrow K) with a knee or foot via a conventional mechanism, the fabric presser 9 (9*a*) is lowered in the direction of the arrow L (FIG. 7), and simultaneously the timing belt 14 (14*a*) mounted by the shaft 15 (15*a*) to the side of the bearing 9*b* is lowered. Also, when the presser foot depressing shaft 31 is rotated in the direction of the arrow K, the shaft 29 is rotated in the direction of the arrow M, thereby forcing the free end of the lever 25 to rotate in the direction of the arrow M' (FIG. 7). This causes downward movement of the connecting rod 27 which is connected to the lever 25 by the pin 26 engaged in the slot 27*b* of the widened end 27*a* of the connecting rod 27. The lever 18 is connected to one end of the connecting rod 27 and is thus rotated downwardly (in the direction of arrow N) about the pin 20 against the biasing force of the compressible spring 23 when the connecting rod 27 is moved downwardly. Such rotation of the lever 18 forces the timing belt pulley 16, which is fixed to the shaft 17 and is rotatably mounted in the yoke 18*a* of the lever 18, to move downwardly and create a clearance Q between the fabric 1 and the presser foot plate 4. When the conventional knee or foot operation is released, the presser foot depressing shaft 31 rotates in the direction opposite to the direction of the arrow K such that, at the same time as the fabric presser 9 (9*a*) is being raised, the timing belt 14 (14*a*) is raised. Thus, the clearance Q ceases to exist and the required proper pressure is again created between the fabric 1 and the presser foot plate 4.

The lever 25, connecting rod 27, spring 23, spring holders 22, 24, presser foot levers 10, 10*a*, presser foot depressing shaft 31, and connecting means 36, 37, 38, 39 are collectively referred to as a raising/lowering means.

Figure 9:
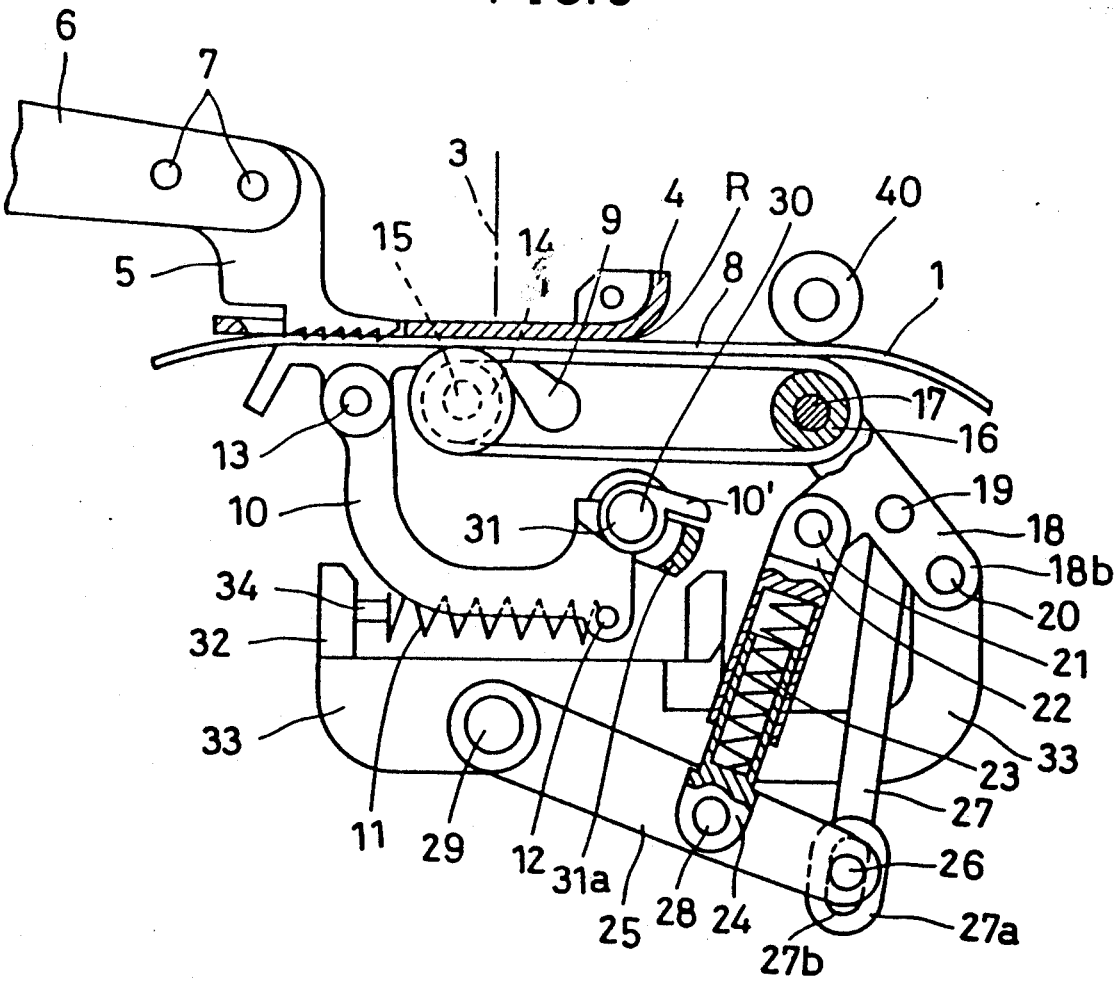
FIG. 9 is a partially sectional left side view of an alternative embodiment of the present invention in which the device is provided with a roller above a belt pulley and in front of a presser foot plate during sewing.
Figure 10:
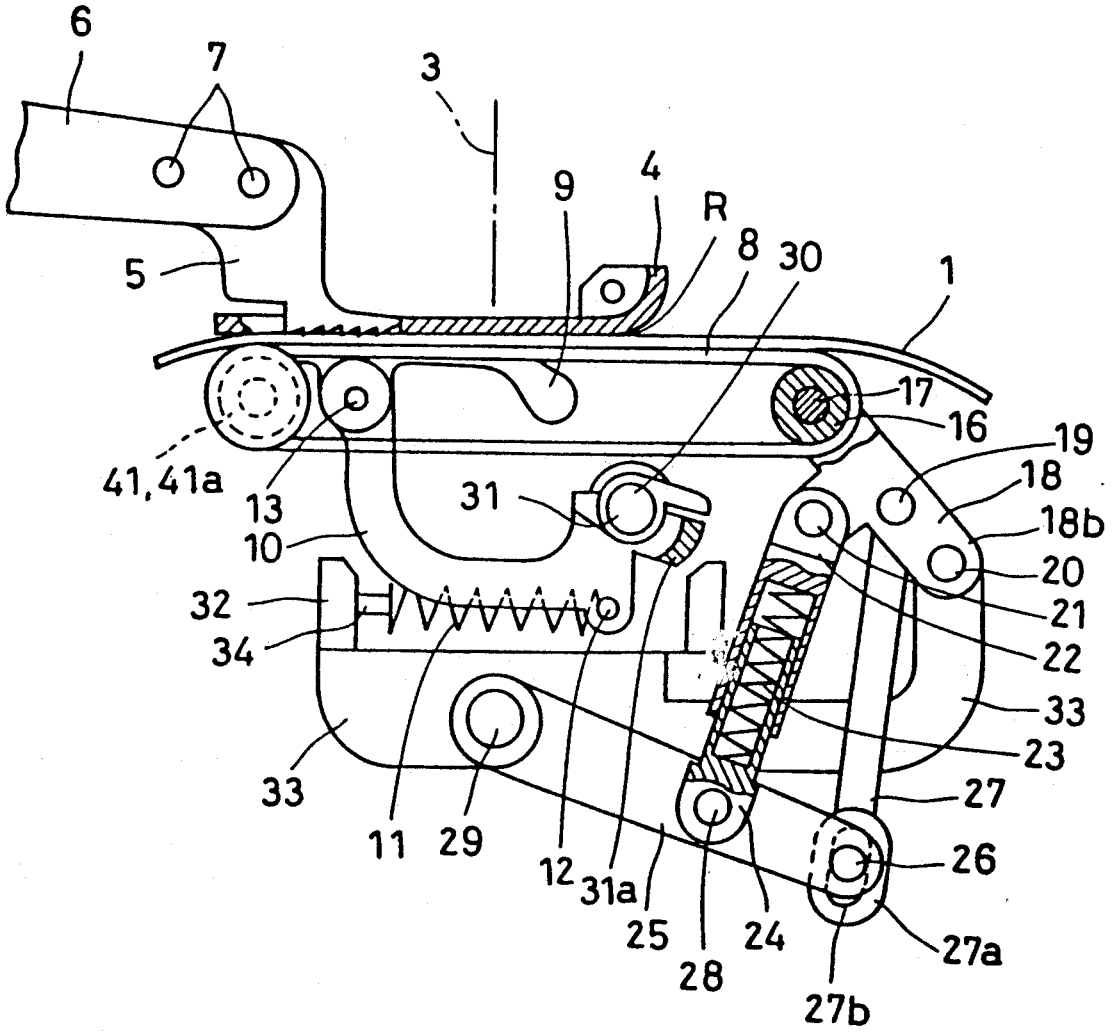
FIG. 10 is a partially sectional left side view of a further embodiment of the present invention in which the belt pulley at the side of the fabric presser in FIG. 4 is provided to the rear of the feed dog during sewing.

FIG. 9 and FIG. 10 show further embodiments of the present invention. As shown in FIG. 9, reference numeral 40 designates a roller which is rotatably mounted to a bracket (not shown in the drawing) and provided above the timing belt pulley 16. This roller 40 rotates freely as it contacts the upper surface of the fabric 1 on the belt 8 (8*a*) and stabilizes movement of the fabric 1 at the feed dog 5 and the belt 8 (8*a*).

In FIG. 10, reference numeral 41 (41*a*) designates a timing belt pulley which is similar to the timing belt pulley 14 (14*a*), but is rotatably mounted to the side of the fabric presser 9 (9*a*) immediately behind and below the feed dog 5. With this arrangement, the fabric 1 is fed to the position R immediately before the presser foot plate 4 is accurately moved by the belt 8 (8*a*) to immediately behind the feed dog 5.

As mentioned above, the present invention is designed such that the belt pulleys 14, 14*a*, 16 are rotatably mounted, by shafts 15, 15*a*, 17, to the sides of the fabric pressers 9, 9*a* immediately forward of and below the feed dog 5. The lever 18 is rotatably mounted in front of the fabric presser 9 (9*a*), and the belt 8 (8*a*) is trained between the belt pulley 14 (14*a*) at the side of the fabric presser 9 (9*a*) and the belt pulley 16 which is mounted to the lever 18. The pulley 16, which is mounted to lever 18, is caused to move upwardly and downwardly as the fabric presser 9 (9*a*) is moved upwardly toward the presser foot plate 4 and downwardly away from the presser foot plate 4 by rotation of the lever 18. This rotation of lever 18 is caused by rotation of the presser foot depressing shaft 31 which is connected to a conventional knee or foot operated mechanism. Therefore, it is unnecessary when beginning the sewing operation to place the fabric 1 under the feed dog 5 at the rear of the part where the needle 3 passes, as is the case with the conventional blindstitching machine. If only the starting edge 1*a* of fabric is placed in front of the seam forming position ahead of the presser foot plate 4, the fabric 1 is carried to immediately forward of the feed dog 5 by the belt 8 (8*a*) along the undersurface of the presser foot plate 4 and is further carried by the feed dog 5. Thus, if the blindstitching machine according to the invention is actuated upon placing the starting edge 1*a* of the fabric 1 in front of the seam forming part, seams can be formed perfectly beginning at the starting edge 1*a* of the fabric.

Since, with the present invention, it is only necessary to actuate the blindstitching machine and place the starting edge 1*a* of fabric 1 immediately in front of the presser foot plate 4 (position R), blindstitching can be carried out, beginning with the edge 1*a* of the fabric. Therefore, no portion is left unseamed, and it is not necessary to sew the unseamed portion manually after mechanical blindstitching operation has been carried out, as is necessary with the conventional blindstitching machine. Thus, the present invention can simplify the blindstitching operation.

Therefore, when the device according to the present invention is used for blindstitching, the seam is not sewn partially mechanically and partially manually, such that the two types of seams are not intermixed. Thus, a uniformly finished workpiece can be obtained that is not of a lesser value due to non-uniform stitching.

I claim:

1. A seam forming device for a blindstitching machine, comprising:

a frame having a front end and a rear end;

a feed dog mounted to said frame for use in feeding a fabric in a rearward direction;

a presser foot plate mounted for movement with said feed dog and extending forwardly of said feed dog;

at least one fabric presser mounted to said frame beneath said feed dog and said presser foot plate for use in pressing the fabric against said feed dog and said pressure foot plate;

at least one first pulley rotatably mounted to said at least one fabric presser such that said at least one first pulley is positioned substantially beneath said at least one fabric presser, respectively;

a first lever rotatably mounted to said frame at a position forward of said at least one fabric presser;

a second pulley rotatably mounted to said first lever;

at least one belt trained about said second pulley and said at least one first pulley, respectively, and being adapted to be rotated about said second pulley and said at least one first pulley so as to feed the fabric from a position just forward of said presser foot plate toward said feed dog; and raising/lowering means for raising and lowering said second pulley and simultaneously respectively raising and lowering said at least one fabric presser, so as to form a clearance between said presser foot plate and said fabric presser.

2. A seam forming device as recited in claim 1, wherein said at least one fabric presser comprises two side-by-side fabric pressers;

said at least one first pulley comprises two first pulleys which are respectively rotatably mounted to said two fabric pressers at opposite outer sides thereof; and said at least one belt comprises two belts, a first of which is trained about said second pulley and one of said two first pulleys, and a second of which is trained about said second pulley and the other of said two first pulleys.

3. A seam forming device as recited in claim 2, wherein an upper end of said first lever comprises a yoke; and said second pulley is rotatably mounted in said yoke.

4. A seam forming device as recited in claim 3, wherein said frame comprises a bracket which is adapted to be fixed to a top end of a blindstitching machine body;

said first lever is rotatably mounted at a first end thereof to a front end of said bracket; and said raising/lowering means comprises a second lever rotatably mounted at a first end thereof to a rearward end of said bracket, a connecting rod rotatably mounted at a first end thereof to a second end of said second lever and at a second end thereof to a center portion of said first lever, and a spring means interposed between respective center portions of said first and second levers for biasing said first and second levers to rotate away from one another.

5. A seam forming device as recited in claim 4, wherein said raising/lowering means further comprises at least one presser foot lever mounted at a first end thereof to said fabric pressers, a presser foot depressing shaft fixed for rotation with a second end of said at least one presser foot lever and being adapted to be rotated by a knee or foot, and connecting means for operably connecting said presser foot depressing shaft to said second lever such that said second lever is forced to rotate about its first end when said presser foot depressing shaft is rotated.

6. A seam forming device as recited in claim 5, wherein said spring means comprises a first spring holder rotatably mounted to a center portion of said first lever, a second spring holder rotatably mounted to said second lever, and a compression spring interposed between said first and second spring holders.

7. A seam forming device as recited in claim 5, further comprising biasing means for biasing said fabric pressers upwardly toward said presser foot plate.

8. A seam forming device as recited in claim 5, wherein said first end of said connecting rod has a slot formed therein; and a pin is mounted to said second end of said second lever, and is engaged in said slot, such that said first end of said connecting rod is rotatably and slidably mounted to said second end of said second lever.

9. A seam forming device as recited in claim 5, wherein said belts comprise timing belts having rugged outer surfaces.

10. A seam forming device as recited in claim 5, wherein said belts comprise timing belts having flat outer surfaces.

11. A seam forming device as recited in claim 4, wherein said first end of said connecting rod has a slot formed therein; and a pin is mounted to said second end of said second lever, and is engaged in said slot, such that said first end of said connecting rod is rotatably and slidably mounted to said second end of said second lever.

12. A seam forming device as recited in claim 1, wherein an upper end of said first lever comprises a yoke; and said second pulley is rotatably mounted in said yoke.

13. A seam forming device as recited in claim 12, wherein said frame comprises a bracket which is adapted to be fixed to a top end of a blindstitching machine body;

said first lever is rotatably mounted at a first end thereof to a front end of said bracket; and said raising/lowering means comprises a second lever rotatably mounted at a first end thereof to a rearward end of said bracket, a connecting rod rotatably mounted at a first end thereof to a second end of said second lever and at a second end thereof to a center portion of said first lever, and a spring means interposed between respective center portions of said first and second levers for biasing said first and second levers to rotate away from one another.

14. A seam forming device as recited in claim 13, wherein said raising/lowering means further comprises at least one presser foot lever mounted at a first end thereof to said at least one fabric presser, a presser foot depressing shaft fixed for rotation with a second end of said at least one presser foot lever and being adapted to be rotated by a knee or foot, and connecting means for operably connecting said presser foot depressing shaft to said second lever such that said second lever is forced to rotate about its first end when said presser foot depressing shaft is rotated.

15. A seam forming device as recited in claim 14, wherein said spring means comprises a first spring holder rotatably mounted to a center portion of said first lever, a second spring holder rotatably mounted to said second lever, and a compression spring interposed between said first and second spring holders.

16. A seam forming device as recited in claim 14, further comprising biasing means for biasing said at least one fabric presser upwardly toward said presser foot plate.

17. A seam forming device as recited in claim 14, wherein said first end of said connecting rod has a slot formed therein; and a pin is mounted to said second end of said second lever, and is engaged in said slot, such that said first end of said connecting rod is rotatably and slidably mounted to said second end of said second lever.

18. A seam forming device as recited in claim 14, wherein said at least one belt comprises at least one timing belt having a rugged outer surface.

19. A seam forming device as recited in claim 14, wherein said at least one belt comprise at least one timing belt having a flat outer surface.

* * * * *